United States Patent [19]

Morgan

[11] 4,246,938

[45] Jan. 27, 1981

[54] VAPOR COLLECTING SYSTEM

[75] Inventor: Glenn G. Morgan, Houston, Tex.

[73] Assignee: Texaco Inc., White Plains, N.Y.

[21] Appl. No.: 36,626

[22] Filed: May 7, 1979

[51] Int. Cl.[3] ..... B65B 3/04

[52] U.S. Cl. ..... 141/52; 62/54; 220/85 VS; 417/29

[58] Field of Search ..... 220/85 VS, 85 VR, 216; 62/54; 417/29, 44; 141/1-11, 37-66, 285

[56] References Cited

U.S. PATENT DOCUMENTS 2,899,013 8/1959 Carter ..... 417/44

*Primary Examiner*—Houston S. Bell, Jr.

*Attorney, Agent, or Firm*—Carl G. Ries; Robert A. Kulason; Robert B. Burns

[57] ABSTRACT

A system for safely and efficiently collecting vapors which might otherwise be released during the storage or transfer of a volatile liquid to and from a storage facility. The system includes a collapsible walled receptacle or reservoir which is connected to receive vapors from the storage facility. A compressor or other vapor evacuation means is also connected to the storage tank as well as to the collapsible walled receptacle. The compressor functions intermittently to remove vapors from both units. The collapsible walled unit includes a level sensing means which is adapted to in effect, sense the volume of vapor held within the collapsible walled receptacle and thus to actuate the compressor control means between predetermined levels.

7 Claims, 1 Drawing Figure

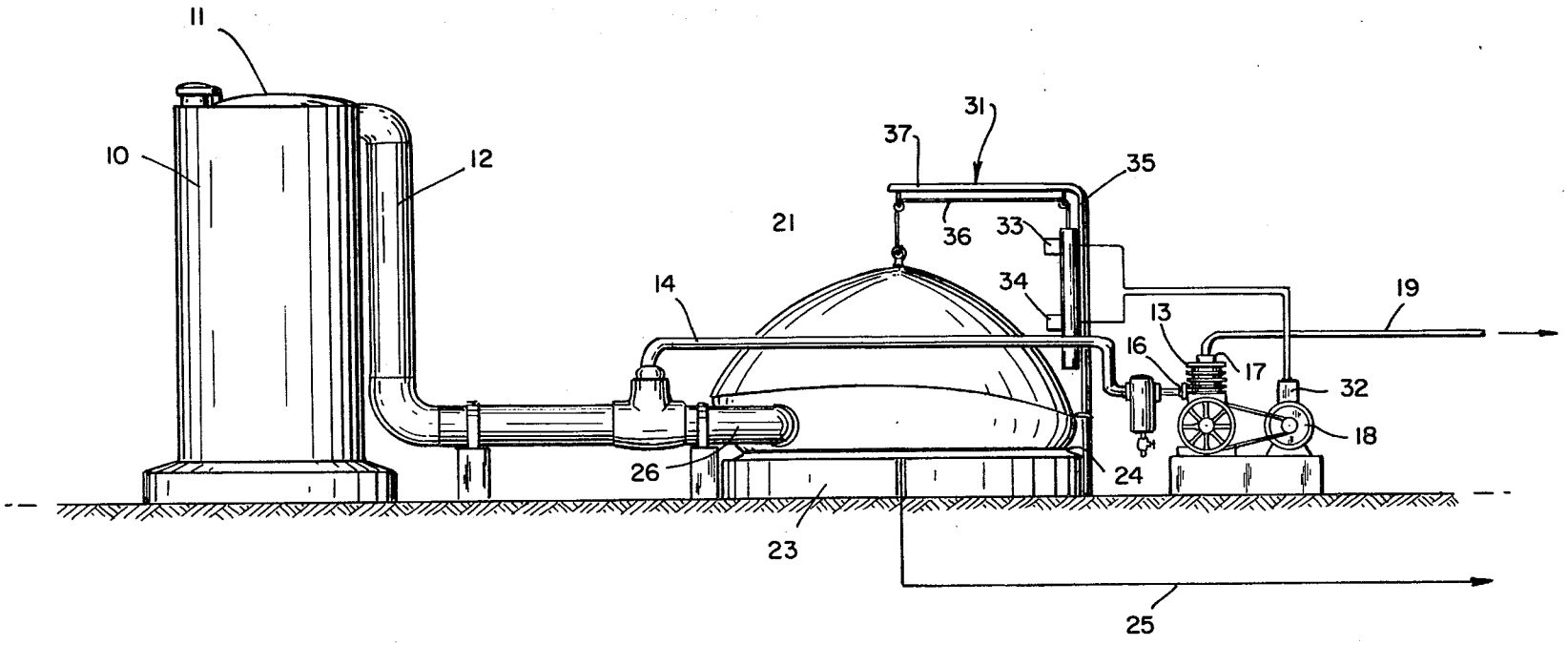
10
11
12
14
21
23
24
25
26
31
32
33
34
35
36
37
13
16
17
18
19

VAPOR COLLECTING SYSTEM

BACKGROUND OF THE INVENTION

Volatile liquids such as crude oil and other refined petroleum products must normally be stored for a period of time after recovery or after being produced. As a matter of practicality the liquid is either piped or carried to a tank farm or a tank battery. Thereafter it is gradually withdrawn as needed either to be processed further, stored, or shipped elsewhere.

In any instance, the stored volatile product will normally cause a vapor accumulation beneath the tank top. Depending on what the stored product is, these vapors can be dangerous to the atmosphere, or even constitute an explosive mixture.

As an example, vapor recovery systems used to gather and compress rich gas vapors from crude oil stock tanks have been in existence for many years. Such systems generally bleed off vapors, at near atmosphere pressure, compress them, and pass them on. These systems are, however, generally designed with a vapor removing compressor of sufficient capacity to handle a predetermined volume of gas which emanates from the stored liquid.

Normally the vapor compressor takes its suction from a storage tank vapor line and then discharges the compressed gas either into a sales point or other gathering system for further handling. While it is relatively simple to handle large volumes of stored liquid and consequently large volumes of vapor, the same does not hold for handling smaller volumes.

Cost and technical factors constitute one reason why many operators avoid handling smaller volumes of gas and liquid. However, energy conservation considerations, as well as gas pricing factors, coupled with various environmental regulations have altered this philosophy. Today, producers must reconsider the retention of these rich vapors that are normally lost to the atmosphere or are merely burned to be disposed of.

The most pertinent problems that arise in most known vapor recovery units are due to changing or variable gas volumes. Compressors which are incorporated into the system generally stop and start, or bypass the gas at such times as suitable pressure sensitive switches indicate low or high volumes. Further, volume surges of vapor will present problems to a compressor operation which is adapted or built for a relatively even vapor flow.

If, for example, the compressor is of a sufficiently large capacity for gas surges, that is, when a large volume of vapor is being generated, it must bypass gas and alternately shut down between such surges. However, bypassing of the gas around the compressor for any length of time is an inefficient operation. It can for example cause damage to the compressor if the unit is operated in this manner over long periods of time without adequate protection.

If the compressor shuts down, and must soon be started up again, the electrical starting contacts tend to rapid deterioration from such abusive use since this can exceed normally designed contact life. Added to this, the tank batteries when full have very small vapor space, a factor which further aggravates the compressor's stop-start system as well as the compressor's bypass system.

To compound these problems, in some instances rapid evacuation of storage tank liquids to a pipeline starves the compressor and can actually cause an ingestion of air into the tanks through the vacuum breakers. This air is then pumped into the gas system.

To rectify this latter problem, pressure reducing regulators are utilized to inject gas in the system. Consequently, a series of low pressure control systems must be delicately balanced and maintained at all times to achieve any semblance of continuous efficient operation.

It is therefore desirable to provide means for safely and effectively receiving and holding vapors from a volatile contained liquid. It is appreciated, however, that such accumulations of vapor will, if contained, build to excessive pressures. To assure only a minimal vapor pressure build-up, a flexible walled or expandable reservoir is provided in which to receive these vapors which would otherwise be forced into the atmosphere by way of a venting means. The expandable receptacle or reservoir functions in conjunction with a compressor and a controller, whereby to periodically activate the compressor to remove a predetermined amount of vapor.

It is therefore an object of the invention to provide storage means for a volatile liquid which avoids passage of harmful vapors into the atmosphere.

A further object is to provide storage and transfer means for holding both liquid and vaporous material, the latter being held in such manner that venting of the vapors is avoided.

A still further object is to provide a system for holding a volatile liquid in which an expandable walled reservoir or container is provided to retain vapors until the latter are disposed of by periodically actuating a compressor which is so connected to withdraw said vapors.

DESCRIPTION OF THE DRAWING

The drawing illustrates a vertical elevation view of an installation embodying the present collapsible walled tank.

The instant system is applicable to the storage and transfer of a number of different volatile liquids. For example, it can be readily used for holding quantities of crude oil, or refined petroleum products such as gasoline. To facilitate the following description, the liquid held and from which the vapors pass, will be considered to be crude oil.

Normally, relatively large quantities of such product are accumulated at tank farms or the like. Thus, the crude liquid is piped into and held within discrete but interconnected storage tanks prior to being further transferred by vehicle, pipeline or other means.

The crude product, however, may also be held in an installation such as a refinery where it will be treated. After the latter, the varying grades of product can again be segregated and held in suitable tanks for further shipment.

Referring to the drawings, an installation of the type contemplated includes at least one and preferably a plurality of liquid holding tanks 10. Said tanks are normally interconnected and manifolded in a manner such that they might be individually filled or emptied. Further they are normally fabricated of metallic construction being welded into a substantially vapor tight closure.

Optionally, the respective tanks 10 can be provided with a floating roof as is often found in tanks of this type. In either instance, the amount of liquid held in the tanks at any one time will be dependent on the inflow to the tank battery. The latter can be from a producing field, from a tanker, or other liquid holding means.

While the present drawings do not illustrate an intake means for the tank it is assumed that suitable valving, manifolding and pumping means will be provided for moving the liquid product into the tank 10.

Inlet and outlet means are provided to each tank 10 and include the usual control valves, gauges, conduits and the like which serve to regulate the flow of the liquids. Vapors which pass from the confined liquid or holding area of tank 10 will rise to the tank top where they will be confined beneath roof 11.

The tank 10 upper end is provided with a vapor discharge line or manifold 12 which opens into the tank interior adjacent roof 11. Said line will thus receive only vapors which have accumulated in the latter. Vapor line 12 is relatively large in cross-sectional area to accommodate the volume of vapor passing from the tank, in contrast with the amount of liquid passed therefrom.

Vapor line 12 is communicated with a compressor 13 through a second vapor line 14. The latter is communicated in turn with the compressor suction 16. Compressor 13 includes the usual vapor compressing unit having a suction 16 and discharge ports 17 respectively, and being driven by a suitable engine or power source such as electric motor 18, preferably electrically controlled as will be hereafter noted.

The control means to regulate the compressor 31 function, reside in any one of a number of controllers well known for this type of operation. Such control means are generally adapted to be opened and closed in response to an external sensor or the like whereby to actuate the compressor between on and off conditions.

Discharge port 17 of compressor 13 will carry compressed gas through conduit 19 either to a gas gathering point or to an alternate storage means.

A bypass means for receiving vapor is embodied in the flexible walled reservoir or tank 21 which is communicated to a bypass line 26 connected directly to the vapor line 12. Said reservoir 21 comprises primarily a vapor tight receptacle preferably mounted on a base or foundation 23 having a liquid drain 25. At least a portion of the walls of said reservoir are of a flexible nature.

In the present instance and as shown, the flexible walled reservoir is comprised of a lower rim 24 which is sealably engaged to base 23. The generally dome shaped flexible wall upper portion can assume a somewhat hemispherical shape when filled with a vapor. However, it will collapse to a relatively flat disposition when the vapor is removed.

Because of the flexible nature of this container's walls, the internal pressure will be relatively low. Thus, depending on the weight of the wall fabric, the movement of said walls in a vertical direction will be rather large in response to a relatively small pressure differential.

When compressor 13 is non-operative, vapors generated within storage tank 10 will be passed through vapor line 12, bypass vapor line 26, and into the flexible walled reservoir 21. The latter will gradually, over a period of time, assume a full or expanded disposition until achieving the shape shown in the accompanying illustration.

Sensing means 31, operably connected to reservoir 21 will sense the disposition of the reservoir and will in response initiate signal to the motor controller 32. Thus, at the position shown, compressor motor 18 will be actuated in response to a signal sent by first sensor 33.

Thereafter, compressor 13 upon actuation will draw vapor from the flexible walled container 21, as well as from tank 10, and through line 14. Withdrawal will continue for a sufficient period of time until the container 21 walls commence to collapse. At that time the peak or upper wall roof will lower or collapse to a lower limitation.

When roof 11 reaches said limitation, a second sensor 34 will sense the level of the roof and in response send a signal to the motor controller 32. Said second signal will cause motor 18, and consequently compressor 13 to stop.

Thereafter, since the vapor will be continually generated within one or more storage tanks 10, the volume of the collapsible reservoir 21 will again commence to build up.

As shown in the drawing, in one embodiment, the sensing means 31 includes a plurality of upper and lower sensor points 33 and 34. The actual sensors can take on the configuration of an electric eye or other suitable arrangement which is directed horizontally outward. In the present embodiment, there is shown spaced apart switches at 33 and 34. Each switch is disposed along a vertical positioning track 35, at a predetermined height with respect to the operational limits of flexible walled tank 21.

A travelling member not shown, which moves between switches at 33 and 34, actuates the latter between the off and on positions. Said travelling member is connected in turn to a cable 36 or the like which in turn is connected to the roof of the collapsible walled reservoir 21. Thus, cable 36 will be moved in response to displacement of the roof. Cable 36 is supported by pulleys or the like from an overhanging track or bracket 37.

So long as the storage tanks 10 are receiving a liquid inflow, or are merely holding a quantity of the volatile liquid, the vapors generated therefrom will flow through the vapor discharge line 12. Further, so long as such flow continues operation of the low pressure collapsible walled reservoir 21 in response to the amount of vapor held therein will cause compressor 13 to intermittently operate and shut off, whereby to relieve the pressure within said collapsible walled reservoir.

Other modifications and variations of the invention as hereinbefore set forth can be made without departing from the spirit and scope thereof, and therefore, only such limitations should be imposed as are indicated in the appended claims.

I claim:

1. In a system for handling a vaporizable liquid and including at least one liquid storage tank for holding amounts of said liquid, said storage tank having a vapor outlet communicated with a vapor compressor, the latter being intermittently operable to remove vapor from the tank, and a variable volume reservoir having a flexible walled vapor holding chamber therein communicated with said storage tank vapor outlet to receive a flow of vapor therefrom during periods when the compressor is in non-operating condition; the improvement in said system of;

control means in said compressor being actuatable to regulate operation of the compressor between on and off conditions, sensing means connected with said variable volume reservoir to sense upper and lower volumetric limits of vapor contained within said flexible walled holding chamber, said sensing means being connected with said control means, whereby to regulate operation of said compressor control means in response to said reservoir limitations being attained.

2. In a system as defined in claim 1, wherein said vapor holding chamber within said reservoir is adapted to be varied in size in accordance with the amount of vapor held therein.

3. In a system as defined in claim 1, wherein a vapor holding chamber within said reservoir includes a portion thereof which is displaceable in response to vapor pressure within the reservoir.

4. In a system as defined in claim 1, wherein a vapor holding chamber within said reservoir includes a portion that will adjust vertically in response to a variation in pressure within the chamber.

5. In a system as defined in claim 1, wherein said flexible walled vapor holding chamber includes a base, said flexible wall depending from said base and being movable vertically during operation of the compressor to fill the chamber.

6. In a system as defined in claim 4, wherein said sensing means is connected to said vapor holding chamber at said vertically adjustable section.

7. In a system as defined in claim 1, wherein said sensing means includes an upright support bracket disposed adjacent to said vapor holding chamber, spaced apart switches carried on said upright bracket, and being connected to said control means, and a traveller member carried on said vertical bracket to contact said switches for controlling said compressor.

* * * * *